US011253122B2

(12) United States Patent
Sun et al.

(10) Patent No.: US 11,253,122 B2
(45) Date of Patent: Feb. 22, 2022

(54) SUCTION NOZZLE AND CLEANER

(71) Applicant: LG Electronics Inc., Seoul (KR)

(72) Inventors: Changhwa Sun, Seoul (KR); Sangjo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 597 days.

(21) Appl. No.: 16/256,067

(22) Filed: Jan. 24, 2019

(65) Prior Publication Data

US 2019/0231155 A1 Aug. 1, 2019

(30) Foreign Application Priority Data

Jan. 29, 2018 (KR) ..... 10-2018-0010924

(51) Int. Cl.
*A47L 9/04* (2006.01)

(52) U.S. Cl.
CPC ..... *A47L 9/0477* (2013.01); *A47L 2201/04* (2013.01)

(58) Field of Classification Search
CPC ... A47L 9/0477; A47L 2201/04; A47L 7/0057
See application file for complete search history.

(56) References Cited

U.S. PATENT DOCUMENTS

2002/0046437 A1* 4/2002 Bailey ..... A47L 5/24 15/310

FOREIGN PATENT DOCUMENTS

KR 10-2017-0090708 8/2017

* cited by examiner

*Primary Examiner* — Andrew A Horton
(74) *Attorney, Agent, or Firm* — Finnegan, Henderson, Farabow, Garrett & Dunner, LLP

(57) ABSTRACT

A suction nozzle includes a nozzle body including a suction port. The suction nozzle also includes a rotary cleaning unit rotatably mounted in the nozzle body and having a cleaning element for cleaning a floor. Additionally, the suction nozzle includes an anti-winder mounted on the nozzle body and having a plurality of contact parts that overlap a side end of the cleaning element along at least a portion of a rotational path followed by the cleaning element of the rotary cleaning unit when the rotary cleaning unit is rotated.

20 Claims, 8 Drawing Sheets

SUCTION NOZZLE AND CLEANER

CROSS-REFERENCE TO RELATED APPLICATION

The present application claims priority to Korean Patent Application No. 10-2018-0010924, filed on Jan. 29, 2018 in Korea, the entire contents of which is hereby incorporated by reference in its entirety.

BACKGROUND

Field

The present invention relates to a suction nozzle and a cleaner.

Description of the Related Art

In general, a cleaner is a home appliance that removes dirt on a floor by suctioning it. Cleaners may include an automatic cleaner that performs cleaning while traveling by itself and a manual cleaner that a user manually moves to perform cleaning.

Such cleaners may include: a main body having a suction motor for generating a suction force; and a suction nozzle directly or indirectly connected to the main body and having a suction port.

The suction nozzle may include an agitator that is rotated. The agitator sweeps and suctions up dirt such as dust or hairs to the suction port from a floor.

A vacuum cleaner has been disclosed in Korean Patent Application Publication No. 10-2017-0090708 that is a prior art document.

The vacuum cleaner disclosed in the prior art document includes a suction unit having a suction port for suctioning air and dirt.

The suction unit includes a housing and a drum brush rotatably disposed in the housing. The drum brush includes a rotary drum that is rotated by a driving force and brushes mounted on the rotary drum.

A ring-shaped blocking rib is disposed in the housing, so the brushes disposed at an end of the drum brush are accommodated inside the blocking rib.

The brushes accommodated in the blocking rib are in contact with the inner side of the blocking rib.

The brushes include a first brush that picks up dirt and a second brush that is shorter than the first brush and is disposed inside the blocking rib.

According to the prior art document, an end of the first brush and the blocking rib are spaced apart from each other with the second brush accommodated inside the blocking rib, so hairs are wound on the second brush between the end of the first brush and the blocking rib. When hairs are outside the second brush, they are also wound outside the blocking rib.

SUMMARY

The present embodiment provides a suction nozzle that prevents dirt such as hairs from being wound on a rotary cleaning unit or prevents dirt from being stuck between the rotary cleaning unit and a holder supporting the rotary cleaning unit, and a cleaner including the suction nozzle.

The present embodiment provides a suction nozzle and a cleaner that can reduce channel resistance due to a structure for preventing dirt from winding.

The present embodiment provides a suction nozzle and a cleaner that prevent a rotary cleaning unit from being damaged due to a structure for preventing dirt from winding.

The present embodiment provides a suction nozzle in which anti-winders can be separably coupled to a nozzle body and that can prevent easy separation of the anti-winders from the nozzle body, and a cleaner.

According to an aspect, a suction nozzle includes: a nozzle body including a suction port; a rotary cleaning unit being able to rotate in the nozzle body and having a cleaning element for cleaning a floor; and an anti-winder mounted on the nozzle body and having a plurality of contact parts that overlap a side end of the cleaning element along at least a portion of a rotational path followed by the cleaning element of the rotary cleaning unit when the rotary cleaning unit is rotated.

According to another aspect, a cleaner includes: a suction nozzle having a suction port; and a main body communicating with the suction nozzle and having a dust tank storing dust separated from air suctioned through the suction nozzle, in which the suction nozzle includes: a rotary cleaning unit having a cleaning element; a nozzle body rotatably supporting the rotary cleaning unit; and an anti-winder mounted on the nozzle body and having a plurality of contact parts that overlaps a side end of the cleaning element at the suction port when the rotary cleaning unit is rotated.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE EMBODIMENTS

Figure 1:
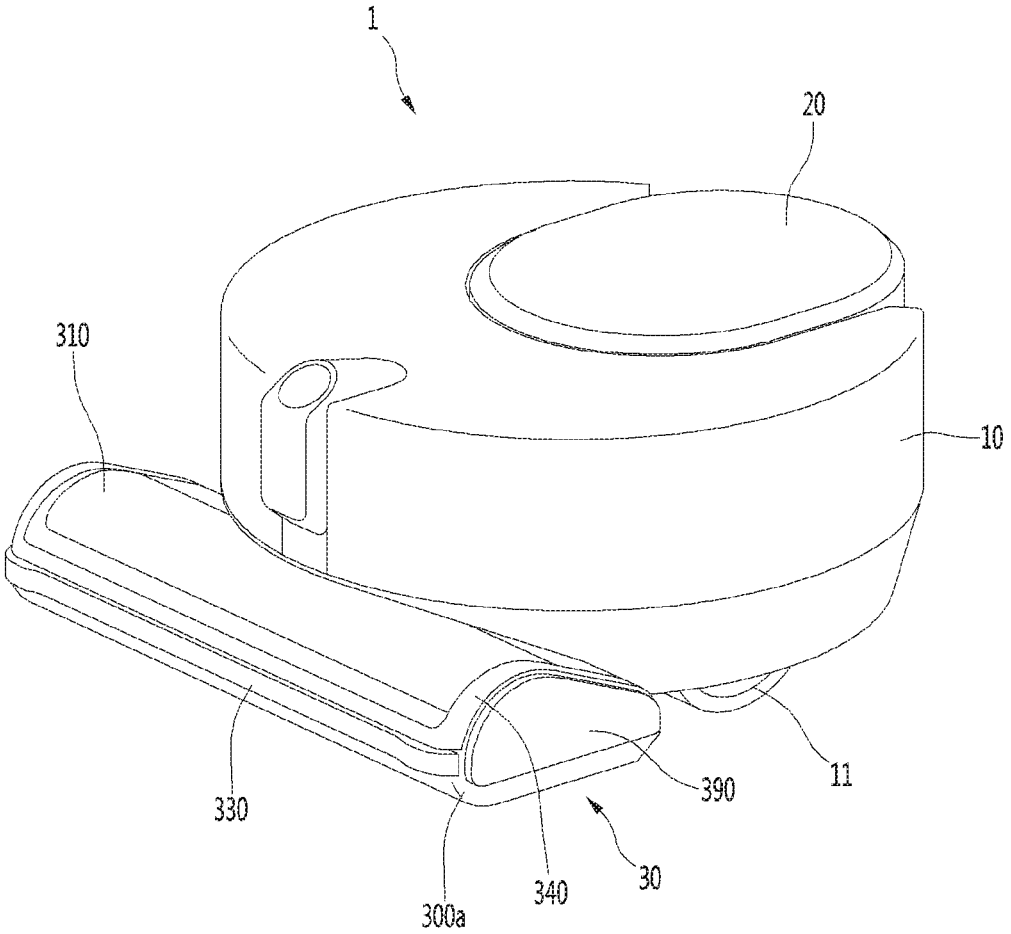
FIG. 1 is a perspective view of a robot cleaner according to an embodiment of the present invention.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
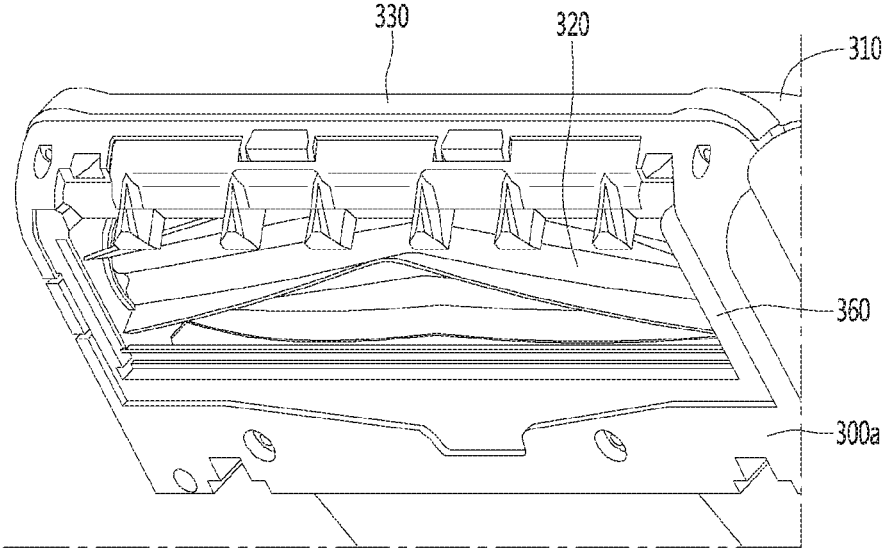
FIG. 2 is a view showing the lower portion of a suction nozzle in the robot cleaner of FIG. 1.
Figure 3:
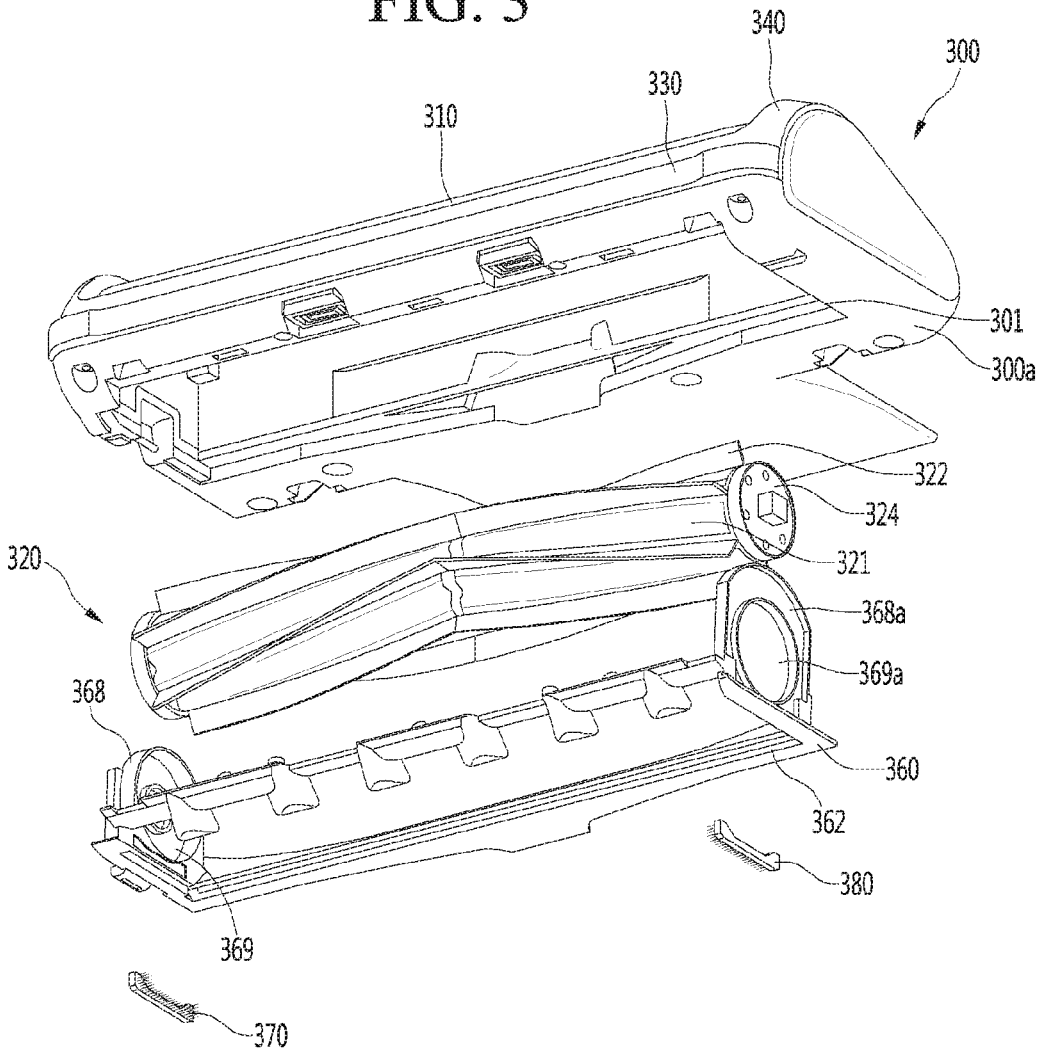
FIG. 3 is an exploded perspective view of the suction nozzle of FIG. 2.

FIG. 1 is a perspective view of a robot cleaner according to an embodiment of the present invention, FIG. 2 is a view showing the lower portion of a suction nozzle in the robot cleaner of FIG. 1, and FIG. 3 is an exploded perspective view of the suction nozzle of FIG. 2.

A robot cleaner is described hereafter as an example of a cleaner including a suction nozzle, but it should be noted that the structure of the suction nozzle of the preset invention can be equally applied to various cleaners other than the robot cleaner.

Referring to FIGS. 1 to 3, a robot cleaner 1 according to an embodiment of the present invention may include a main body 10 having a suction motor (not shown) that generates a suction force.

The main body 10, though not limited, may be formed in a cylinder shape. The height of the main body 10 may be designed smaller than the radius thereof to prevent interference with obstacles when the main body 10 automatically travels and cleans a floor.

The main body 10 may include main wheels 11 for moving. The main wheels 11 are connected to a driving motor (not shown), so they can be rotated.

The robot cleaner 1 may further include a suction nozzle 30 disposed on the front of the main body 10 and a dust tank 20 detachably coupled to the main body 10.

It is possible to suction dust on a floor into the main body 10 through the suction nozzle 30, to separate the dust from air suctioned in the main body 10, and to store the separated dust.

The dust tank 20 may be positioned opposite to the suction nozzle 30 on the main body 10. For example, the dust tank 20 may be disposed at the rear portion of the main body 10.

A portion of the suction nozzle 30 may vertically overlap the main body 10 and the other portion may protrude forward from the main body 10.

A forward protrusion 31, which protrudes forward from the main body 10, of the suction nozzle 30 may be smaller in height than the main body 10.

Accordingly, when the robot cleaner 1 cleans a floor, the forward protrusion 31 can enter a space lower than the height of the main body 10, so the range that the robot cleaner 1 can clean can be increased.

The suction nozzle 30, though not limited, may include: a nozzle body 300 having a suction port 362; and a rotary cleaning unit 320 rotatably disposed in the nozzle body 300.

The nozzle body 300, though not shown, may include a base 300*a* and a cover member 310 that covers the top of the base 300*a*.

A space for accommodating the rotary cleaning unit 320 is defined by the base 300*a* and the cover member 310.

An opening 301 through which the rotary cleaning unit 320 passes may be formed at the base 300*a* to mount the rotary cleaning unit 320.

A bumper 330 may be coupled to the front of the base 300*a* with the base 300*a* and the cover member 310 combined. Alternatively, the bumper 330 may be mounted on the cover member 310.

With the bumper 330 coupled to the base 300*a*, an edge member 340 can surround the edge of the cover member 310 and cover the top of the bumper 330. Alternatively, the edge member 340 may not be a separate part, but may be integrated with the cover member 310.

Side covers 390 may be coupled to both sides of the suction nozzle 30.

Both ends of the bumper 330 may be coupled to the side covers 390 or the cover member 310.

It should be noted that the nozzle body 300 can be configured in various ways and is not limited to the configuration and coupling way described above in this embodiment.

The nozzle body 300 may further include a base cover 360 that covers the bottom of the rotary cleaning unit 320.

The base cover 360 may be manufactured separately from the base 300*a* and then coupled to the base 300*a*.

For example, the base cover 360 may be coupled to the base 300*a* while covering the opening 301.

The base cover 360 may include: a cover body 361 having the suction port 362; and holders 368 and 368*a* extending upward from the cover body 361 and supporting both sides of the rotary cleaning unit 320.

In this embodiment, the holders 368 and 368*a* may be integrated with the cover body 361 or may be integrated with the base 300*a*.

When the holders 368 and 368*a* are integrated with the base 300*a*, the cover body 361 is coupled to the base 300*a* with the rotary cleaning unit 320 supported by the holders 368 and 368*a*, thereby being able to cover the rotary cleaning unit 320.

The rotary cleaning unit 320 may include a cleaning element 322 disposed on the outer side of a rotary body 321.

The cleaning element 322 may extend straight, curvedly, or spirally in the longitudinal direction of the rotary body 321.

Though not limited, a plurality of cleaning elements 322 may be spaced apart from one another in the circumferential direction of the rotary body 321.

Since the cleaning elements 322 are disposed on the outer side of the rotary body 321, the distance from the center of the rotary body 321 to the ends of the cleaning elements 322 is larger than the radius of the rotary body 321.

The cleaning elements 322 may be brushes having a plurality of hairs or brushes made of rubber.

The cleaning elements 322, though not limited, may be coupled to the rotary body 321 by sliding in the longitudinal direction of the rotary body 321.

The rotary cleaning unit 320 may further include rotation guides 324 coupled to both sides of the rotary body 321.

The diameters of the rotation guides 324 may be the same as or larger than the diameter of the rotary body 321. Accordingly, as the rotation guides 324 are coupled to both sides of the rotary body 321, the cleaning elements 322 can be prevented from separating from the rotary body 321.

The suction nozzle 30 may further include an anti-winder 370 and 380 mounted on the base cover 360 to prevent dirt such as hairs from winding around the rotary cleaning unit 320.

For example, a pair of anti-winders 370 and 380 may be mounted on the base cover 360 in contact with the cleaning elements 322 at both sides of the rotary cleaning unit 320.

However, the anti-winders 370 and 380 may be mounted on the base 300*a*, depending on a structural change of the base cover 360. For example, when the holders 368 and 368*a* are formed at the base 300*a*, the anti-winders 370 and 380 may be mounted on the base 300*a*.

Alternatively, even if the holders 368 and 368*a* are formed at the base 300*a*, the anti-winders 370 and 380 may be mounted on the base 300*a*.

Figure 4:
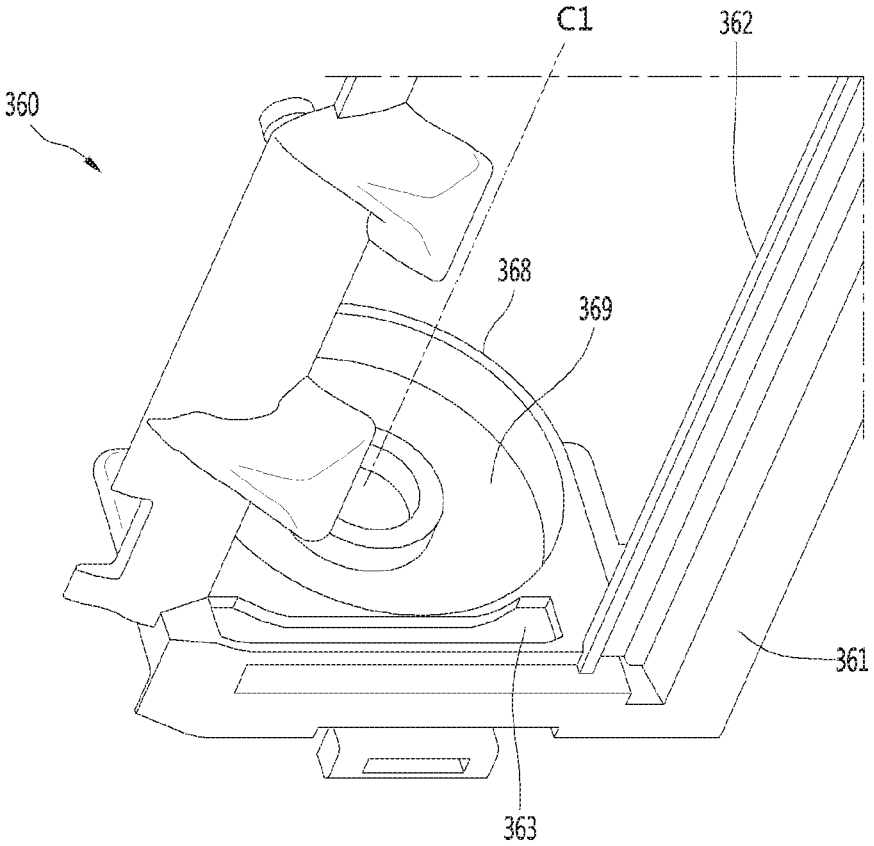
FIG. 4 is a perspective view showing a portion of the configuration of a base cover according to an embodiment of the present invention.
Figure 5:
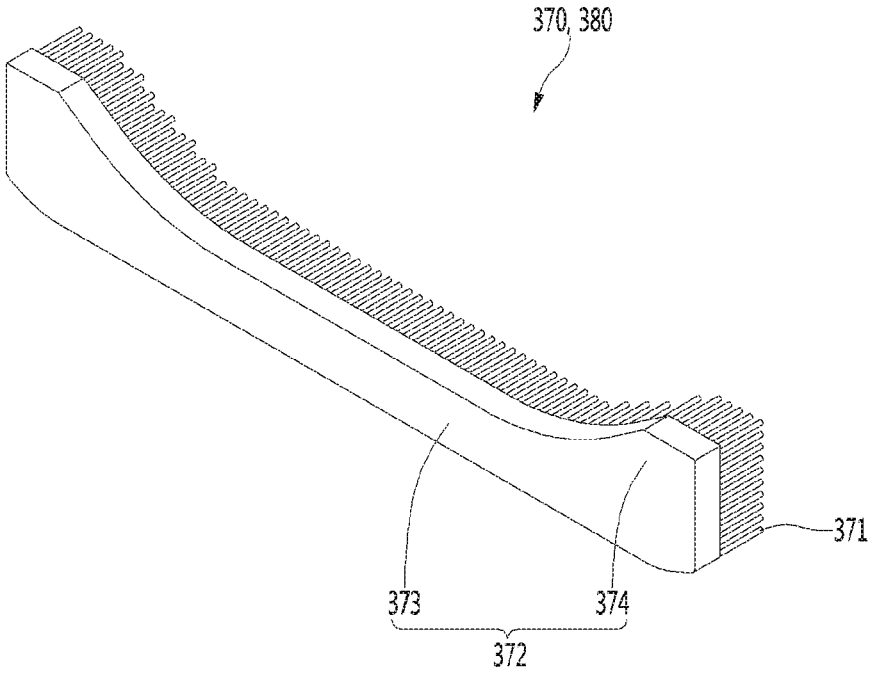
FIG. 5 is a view showing an anti-winder according to an embodiment of the present invention.
Figure 6:
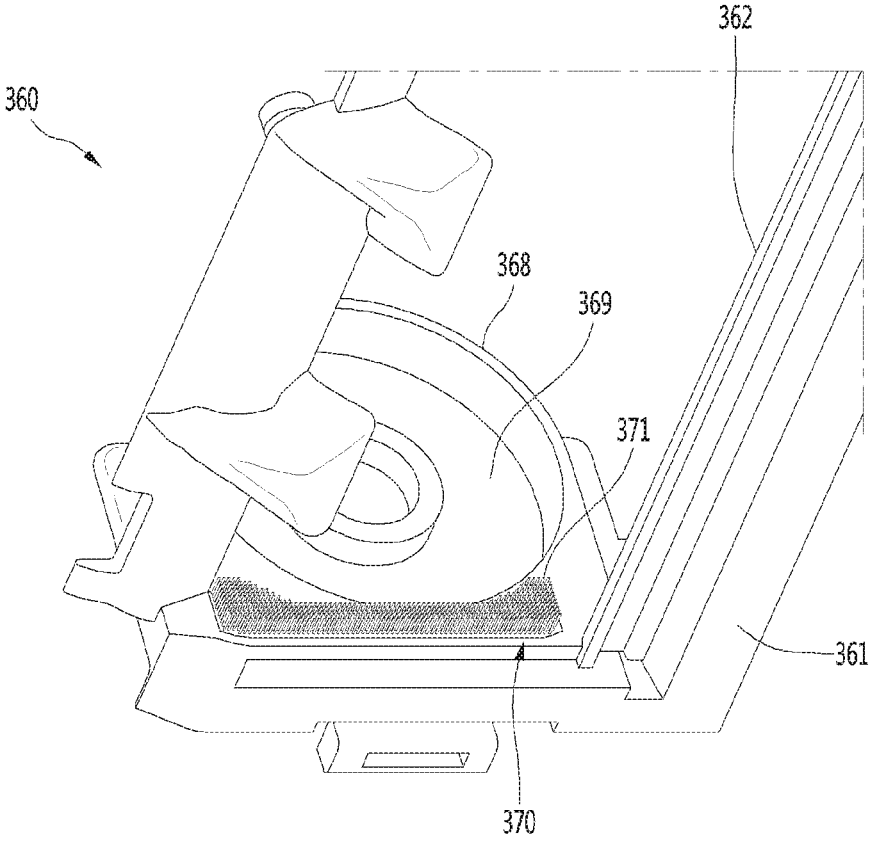
FIG. 6 is a view showing the anti-winder of FIG. 5 coupled to the base cover of FIG. 4.

FIG. 4 is a perspective view showing a portion of the configuration of a base cover according to an embodiment of the present invention, FIG. 5 is a view showing an anti-winder according to an embodiment of the present invention, and FIG. 6 is a view showing the anti-winder of FIG. 5 coupled to the base cover of FIG. 5.

Figure 7:
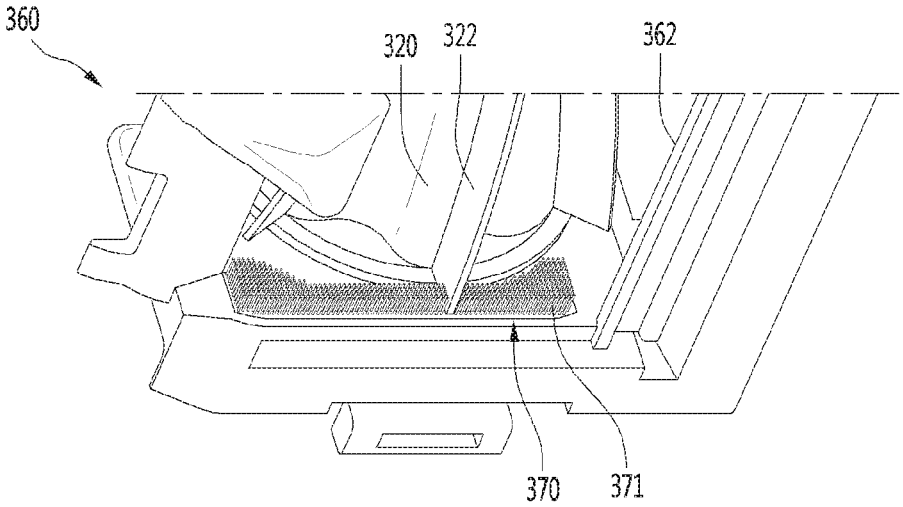
FIG. 7 is a view showing a state in which a side of a rotary cleaning unit of the present invention is in contact with an anti-winder.
Figure 8:
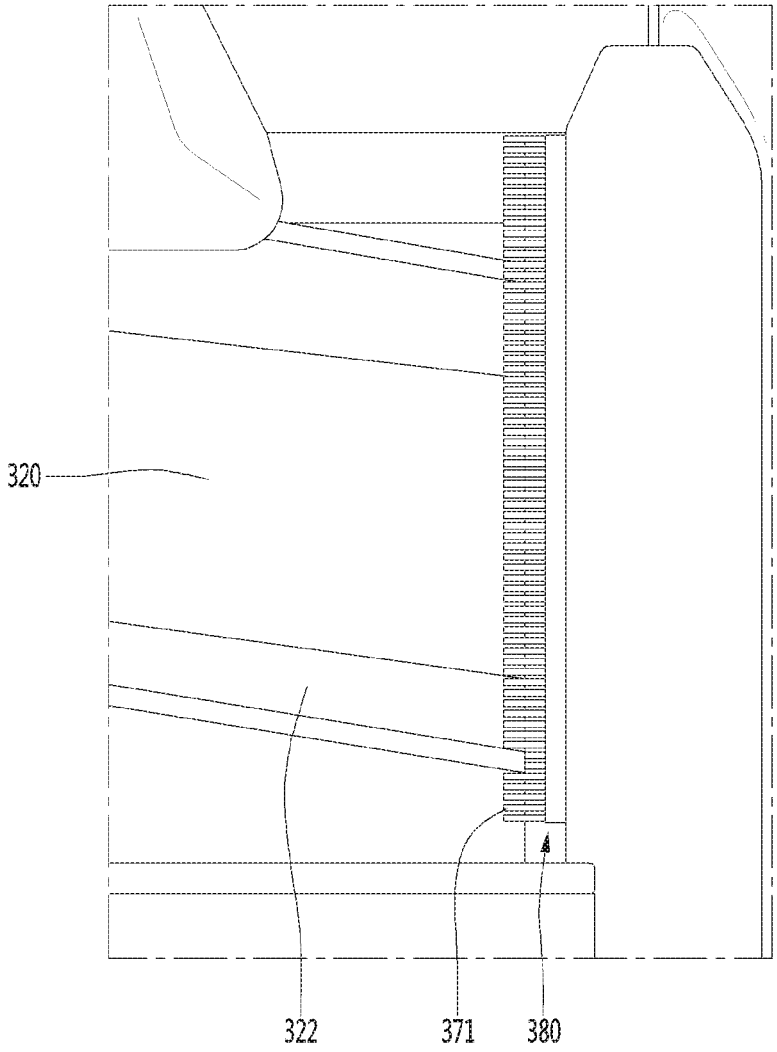
FIG. 8 is a view showing a state in which the other side of a rotary cleaning unit of the present invention is in contact with an anti-winder.

FIG. 7 is a view showing a state in which a side of a rotary cleaning unit of the present invention is in contact with an anti-winder and FIG. 8 is a view showing a state in which the other side of a rotary cleaning unit of the present invention is in contact with an anti-winder.

Referring to FIGS. 3 to 8, the holders 368 and 368*a* may extend upwards from both side ends of the cover body 361.

That is, a pair of holders 368 and 368*a* may extend upward from the cover body 361.

The pair of holders 368 and 368*a* may include a first holder 368 and a second holder 368*a*. The first holder 368 and the second holder 368*a* may respectively have receiving portions 369 and 369*a* for accommodating the rotary cleaning unit 320.

The receiving portion 369 of the first holder 368 may be a groove that accommodates the rotation guide 324 on a side of the rotary cleaning unit 320 and the receiving portion 369*a* of the second holder 368*a* may be a hole through which the other side of the rotary cleaning unit 320 passes.

In any structure, at least the rotation guides 324 of the rotary cleaning unit 320 can be accommodated in the receiving portions 369 and 369*a* of the holders 368 and 368*a*.

Installation portions 363 for mounting the anti-winders 370 and 380 may be formed at the cover body 361 or the holders 368 and 368*a*.

The installation portions 363 may be grooves recessed on the cover body 361 or the holders 368 and 368*a*.

The installation portions may be recessed away from two positions on the cover body 361 or away from the holders 368 and 368*a*

In one exemplary embodiment the installation portions 363 are formed on the holders 368 and 368*a*.

The anti-winders 370 and 380 may have a plurality of contact parts 371 that come in contact with the cleaning elements 322 of the rotary cleaning unit 320 when the rotary cleaning unit 320 is rotated, and a supporting part 372 that supports the contact parts 371.

The contact parts 371 may be formed in a narrow and long shape. Though not limited, the contact parts 371 may include one or more of hair, cotton flannel, and felt not to be damaged due to friction when it comes in contact with the cleaning elements 322.

Alternatively, the contact parts 371 may injection-molded rubber, silicon, and other plastic materials that are flexible materials.

It should be noted that the kind of the contact parts 371 is not limited in the embodiment.

The supporting part 372 can be accommodated in the installation portion 363. The contact parts 371 may protrude out of the installation portion 363 with the supporting part 372 accommodated in the installation portion 363. The contact parts 371 may protrude toward the suction port 362 to be able to come in contact with the cleaning elements 322.

The supporting part 372 can be forcibly fitted in the installation portion 363 without a specific fixing member. In this case, the supporting part 372 may be accommodated in the installation portion 363 in parallel with the extending direction of a rotational center line C1 of the rotary cleaning unit 320.

According to this structure, when the rotary cleaning unit 320 is rotated, the contact parts 371 can be pressed in contact with the cleaning elements 322. The pressure acts in the direction in which the supporting part 372 is accommodated in the installation portion 363, so the supporting part 372 can be prevented from easily separating from the installation portion 363.

Alternatively, the supporting part 372 may be fixed in the installation portion 363 by a double-sided tape or an adhesive.

Alternatively, the supporting part 372 may be fixed in the installation portion 363 by a fastener such as a hook or a screw.

In any case, the supporting part 372 can be separated from the installation portion 363 by the user's intention to separate the supporting part 372 after the supporting part 372 is mounted in the installation portion 363.

This is for making it possible to install new anti-winders 370 and 380 after separating existing anti-winders 370 and 380 from the installation portions 363 even if the contact parts 371 are damaged by continuous friction between the contact parts 371 and the cleaning elements 322.

When the supporting part 372 is mounted in the installation portion 363, the contact parts 371 may be arranged to extend in parallel with the rotational center line C1 of the rotary cleaning unit 320.

The lengths of the contact parts 371 may be larger than the distance from the supporting part 372 to the cleaning elements 322.

Accordingly, when the rotary cleaning unit 320 is rotated, the side ends of the cleaning elements 322 can be rotated while overlapping the contact parts 371 along at least a portion of the rotational path followed by the cleaning elements of the rotary cleaning unit 320 when the rotary cleaning unit 320 is rotated.

In the embodiment, when the contact parts 371 overlap the cleaning elements 322, a gap is prevented between the cleaning elements 322 and the contact parts 371, so it is possible to prevent dirt such as hairs from being winding around the rotary cleaning unit 320, particularly, around the rotary body 361 or the rotation guides 324 where the cleaning elements 322 are not disposed.

The gaps among the contact parts 371 may be set smaller than the thicknesses of the cleaning elements 322 to effectively prevent a gap with the contact parts 371 in contact with the cleaning elements 322.

The stiffness of the contact parts 371 may be smaller than the stiffness of the cleaning elements 322 to prevent damage to the cleaning elements 322 due to the contact parts 371.

For example, the contact parts 371 each may be formed in a cylinder shape and the diameters of the contact parts 371 may be set smaller than the thicknesses of the cleaning elements 322.

When the rotary cleaning unit 320 is rotated, the more the contact area and contact time between the cleaning elements 322 and the contact parts 371 are increased, the more the effect of preventing winding of dirt can be increased.

For example, it is possible to assume that the contact parts 371 are arranged to correspond to the entire circumference of the rotary cleaning unit 320. In this case, the cleaning elements 322 and the contact parts 371 keep in contact with each other while the rotary cleaning unit 320 is rotated, so winding of dirt can be effectively prevented.

However, when the contact parts 371 keep in contact with the cleaning elements 322, the contact parts 371 quickly wear. Further, since the contact parts 371 are supposed to overlap the side ends of the cleaning elements 322 and protrude toward the suction port, the contact parts 371 function as channel resistance, thereby deteriorating the suction ability.

Accordingly, the contact parts 371 may be positioned under the rotational center line C1 of the rotary cleaning unit 320 to prevent winding of dirt and minimize the function as channel resistance of the contact parts 371.

The supporting parts 372 may be at least partially positioned under the receiving portions 369 and 369*a* of the holders 368 and 368*a* to prevent dirt suctioned through the suction port 362 from immediately winding around the rotary cleaning unit 320.

For example, the supporting parts 372 may have first portions 373 positioned under the receiving portions 369 and 369*a* of the holders 368 and 368*a*.

The length of the first portion 373 may be the same as or similar to the front-rear width of the suction port 362.

If the contact parts 371 are provided only at the first portion 373, some of the contact parts 371 at both sides of the first portion 373 may not come in contact with the cleaning elements 322 when the rotary cleaning unit 320 is rotated.

Accordingly, the supporting part 372 may further include second portions 374 extending upward at both sides of the first portion 373 to increase the contact time with the cleaning elements 322.

The uppermost surfaces of the second portions 374 may be positioned higher than the lowermost points of the receiving portions 369 and 369*a*. The tops of the second portions 374 may be rounded to increase the contact area and time with the cleaning elements 322 of the rotary cleaning unit 320 that is rotated.

In the shape of the supporting part 372, the contact parts 371 are arranged in several rows vertically spaced from each other, and the line connecting the contact parts 371 in the uppermost row is a curve.

In another aspect, the supporting part 372 may have a recessed portion recessed downward on the top and the uppermost surface of the supporting part 372 may be positioned higher than the lowermost points of the receiving portions 369 and 369*a*. The recessed portion may have a rounded surface.

While the rotary cleaning unit 320 is rotated, the cleaning elements 322 may be positioned outside the suction port 362.

According to the arrangement and structure of the anti-winders 370 and 380, when at least the cleaning elements 322 are positioned outside the suction port 362, the contact parts 371 can come in contact with the cleaning elements 322, so it is possible to effectively prevent dirt from winding around the rotary cleaning unit 320.

According to the disclosed embodiments, since the anti-winders each having a plurality of contact parts are mounted on the nozzle body and overlap the side ends of the cleaning elements, it is possible to prevent dirt such as hairs from winding around the rotary cleaning unit or to prevent dirt from being stuck between the rotary cleaning unit and the holders supporting the rotary cleaning unit.

Further, according to the present invention, since the contact parts are positioned under the rotational center line of the rotary cleaning unit with the supporting parts mounted in the installation portions, channel resistance by the contact parts can be reduced.

Further, according to the disclosed embodiments, since the diameters of the contact parts may be set smaller than the thicknesses of the cleaning elements and the stiffness of the contact parts is set smaller than the stiffness of the cleaning elements, damage to the cleaning elements when friction occurs between the cleaning elements and the contact parts is prevented.

Further, according to the disclosed embodiments, since the supporting parts that support the contact parts can be separably mounted in the installation portions, it is possible to replace the anti-winders with new ones when the contact parts are damaged by friction.

Further, according to the disclosed embodiments, since pressure is applied to the supporting parts when friction occurs between the cleaning elements and the contact parts with the supporting parts mounted in the installation portions, it is possible to prevent the supporting parts from easily separating from the installation portion after the supporting parts are mounted in the installation portions.

What is claimed is:

1. A suction nozzle comprising:

a nozzle body, the nozzle body including a suction port;

a rotary cleaning unit rotatably mounted in the nozzle body, the rotary cleaning unit including a cleaning element configured for cleaning a floor; and an anti-winder mounted on the nozzle body, the anti-winder including a plurality of contact parts that overlap a side end of the cleaning element along at least a portion of a rotational path followed by the cleaning element of the rotary cleaning unit when the rotary cleaning unit is rotated.

2. The suction nozzle of claim 1, wherein the contact parts are respectively arranged in parallel with a rotational center line of the rotary cleaning unit.

3. The suction nozzle of claim 2, wherein the anti-winder further includes a supporting part, the plurality of contact parts being respectively disposed on the supporting part, and lengths of the respective contact parts being longer than a distance from the supporting part to the side end of the cleaning element.

4. The suction nozzle of claim 3, wherein the nozzle body further includes an installation portion configured for separably mounting the supporting part on the installation portion in parallel with an extending direction of the rotational center line of the rotary cleaning unit.

5. The suction nozzle of claim 3, wherein the contact parts are respectively positioned under the rotational center line of the rotary cleaning unit when the supporting part is mounted on the nozzle body.

6. The suction nozzle of claim 5, wherein the nozzle body further includes a receiving portion configured to receive a portion of the rotary cleaning unit, and the supporting part includes a first portion positioned lower than the receiving portion and second portions extending upward from both sides of the first portion and positioned higher than a lowermost point of the receiving portion.

7. The suction nozzle of claim 6, wherein an uppermost surface of the supporting part is positioned higher than the lowermost point of the receiving portion.

8. The suction nozzle of claim 5, wherein the contact parts are respectively arranged in several rows vertically spaced apart from each other, and a line connecting the contact parts in an uppermost row of the contact parts forms a curve.

9. The suction nozzle of claim 5, wherein the supporting part has a recessed portion recessed downward, and the recessed portion has a rounded surface.

10. The suction nozzle of claim 1, wherein the nozzle body includes:

a base, the base including an opening; and a base cover covering the base, the base cover including the suction port, wherein the rotary cleaning unit and the anti-winder are disposed on the base cover.

11. The suction nozzle of claim 1, wherein the nozzle body includes:

a base, the base including an opening; and a base cover covering the base, the base cover including the suction port, wherein the rotary cleaning unit is disposed on the base and the anti-winder is disposed on the base cover.

12. The suction nozzle of claim 1, wherein the contact parts include one or more of hair, cotton flannel, or felt.

13. The suction nozzle of claim 12, wherein the cleaning element is at least one of a brush including a plurality of hairs or a brush made of rubber.

14. The suction nozzle of claim 1, wherein a diameter of the respective contact parts is smaller than a thickness of the cleaning element.

15. The suction nozzle of claim 1, wherein a stiffness of the respective contact parts is smaller than a stiffness of the cleaning element.

16. The suction nozzle of claim 1, wherein diameters of the respective contact parts are larger than gaps between the respective contact parts.

17. A cleaner comprising:

a suction nozzle, the suction nozzle including a nozzle body and a suction port; and a main body communicating with the suction nozzle, the main body including a dust tank configured for storing dust separated from air suctioned through the suction nozzle, wherein the suction nozzle further includes:

a rotary cleaning unit, the rotary cleaning unit including a cleaning element, and the rotary cleaning unit being rotatably supported in the nozzle body; and an anti-winder mounted on the nozzle body, the anti-winder including a plurality of contact parts respectively configured to overlap a side end of the cleaning element at the suction port when the rotary cleaning unit is rotated.

18. The cleaner of claim 17, wherein the anti-winder includes a supporting part, the supporting part configured to support the plurality of contact parts, the nozzle body further including an installation portion configured for separably mounting the supporting part in the installation portion in parallel with an extending direction of a rotational center line of the rotary cleaning unit.

19. The cleaner of claim 18, wherein the respective contact parts are positioned under the rotational center line of the rotary cleaning unit when the supporting part is mounted on the nozzle body.

20. The cleaner of claim 19, wherein the nozzle body further includes a receiving portion configured to receive a portion of the rotary cleaning unit, and the supporting part includes a first portion positioned lower than the receiving portion and second portions extending upward from both sides of the first portion and positioned higher than a lowermost point of the receiving portion.

* * * * *